US005865459A

United States Patent [19]

Piegay

[11] Patent Number: 5,865,459

[45] Date of Patent: Feb. 2, 1999

[54] SKI STRUCTURE

[75] Inventor: Yves Piegay, Voiron, France

[73] Assignee: Skis Rossignol S.A., Voiron, France

[21] Appl. No.: 657,386

[22] Filed: Jun. 3, 1996

Related U.S. Application Data

[63] Continuation of Ser. No. 154,521, Nov. 19, 1993, abandoned.

[30] Foreign Application Priority Data

Nov. 19, 1992 [FR] France ..... 9214127

[51] Int. Cl.[6] ..... A63C 5/07

[52] U.S. Cl. ..... 280/602; 280/610

[58] Field of Search ..... 280/602, 609, 280/610, 11.16

[56] References Cited

U.S. PATENT DOCUMENTS

| | | | |
|---|---|---|---|
| 2,661,219 | 12/1953 | Coulson, Jr. | 280/602 |
| 3,260,531 | 7/1966 | Heuvel | 280/602 |
| 3,326,564 | 6/1967 | Heuvel . | |
| 4,405,149 | 9/1983 | Piegay | 280/602 |
| 4,848,784 | 7/1989 | Scherübl | 280/602 |
| 4,848,786 | 7/1989 | Mankau | 280/602 |
| 4,875,702 | 10/1989 | Scherübl | 280/602 |
| 5,033,765 | 7/1991 | Cagneux et al. | 280/602 |
| 5,092,618 | 3/1992 | Mayr | 280/602 |
| 5,251,924 | 10/1993 | Nussbaumer | 280/602 |
| 5,333,889 | 8/1994 | Piegay et al. | 280/602 |

FOREIGN PATENT DOCUMENTS

| | | | |
|---|---|---|---|
| 388875 | 9/1989 | Austria . | |
| 062723 | 10/1982 | European Pat. Off. . | |
| 344146 | 11/1989 | European Pat. Off. . | |
| 187726 | 2/1937 | France | 280/602 |
| 2618344 | 6/1968 | France . | |
| 2599636 | 5/1987 | France . | |
| 2615404 | 11/1988 | France | 280/602 |
| 2634385 | 6/1989 | France . | |
| 0098831 | 8/1979 | Japan | 280/602 |
| 675362 | 9/1990 | Switzerland | 280/602 |

*Primary Examiner*—J. J. Swann
*Assistant Examiner*—Michael Mar
*Attorney, Agent, or Firm*—Oliff & Berridge, PLC

[57] ABSTRACT

A ski structure has a core that can be provided with reinforcing elements and is provided with upper and lower covering elements. At least one cavity is provided in the core and has a terminal end that terminates in at least one of the upper surface and lower surface of the core. The ski structure cavity is covered by at least one of the upper and lower covering element and the edges of the ski. At least one block made of, for example, elastic, hyperelastic, or viscoelastic material is provided in the at least one cavity. The height of each block is preferably greater than 5 mm while the ratio between the height and the length of the block is preferably between 0.3 and 7.

28 Claims, 4 Drawing Sheets

FIG 1
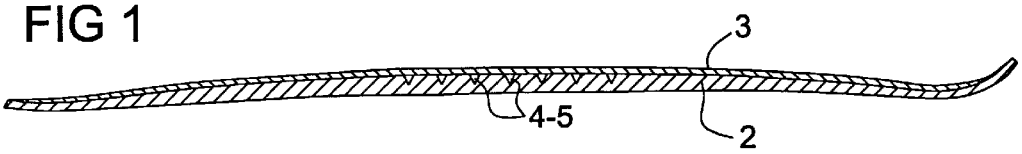
FIG 2
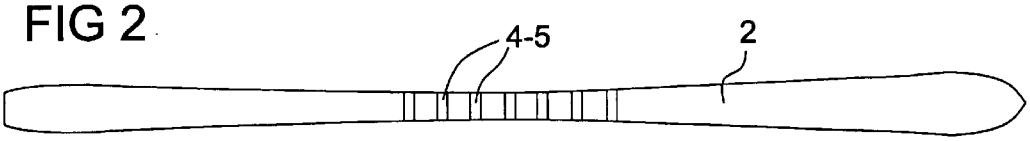
FIG 3
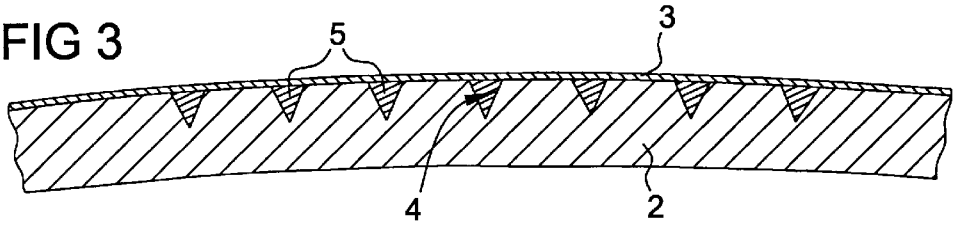
FIG 4
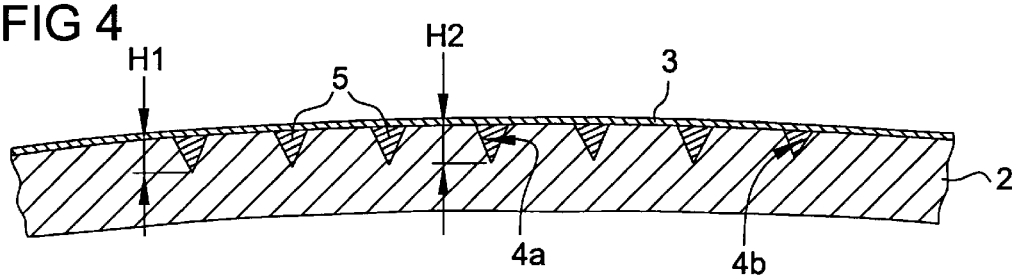
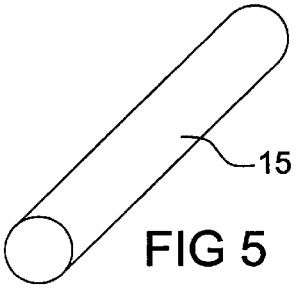
FIG 5
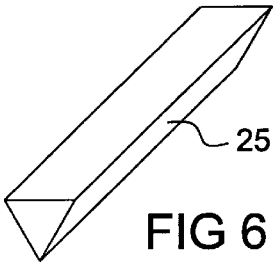
FIG 6
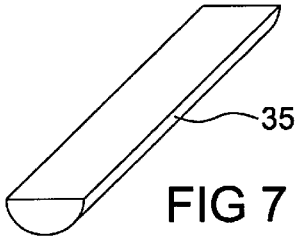
FIG 7
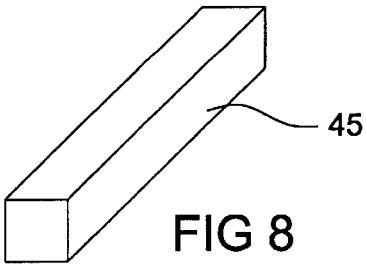
FIG 8
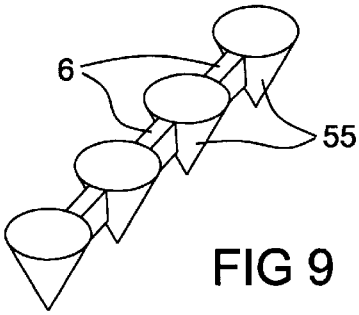
FIG 9

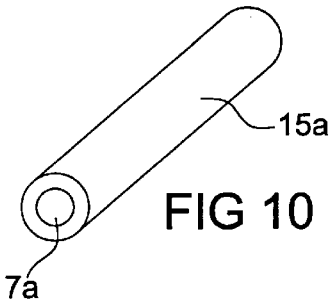
FIG 10
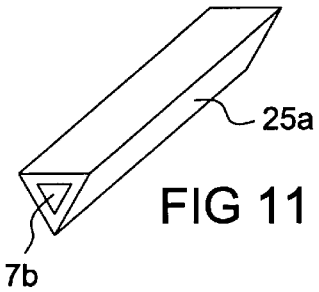
FIG 11
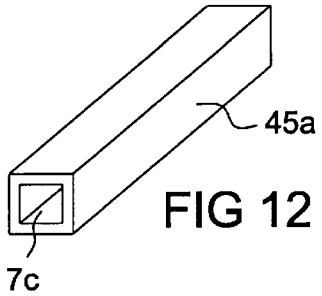
FIG 12
FIG 13
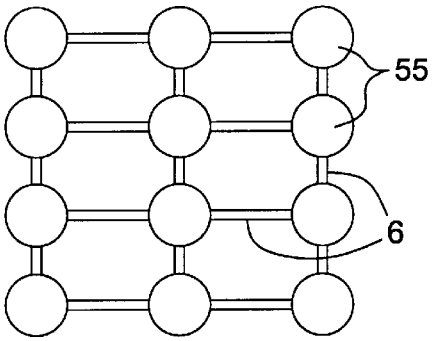
FIG 14
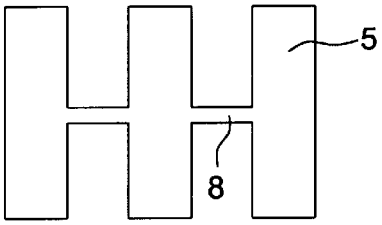
FIG 15
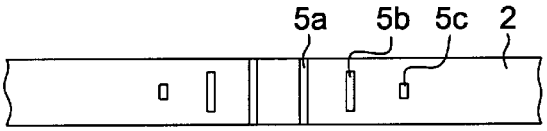
FIG 16
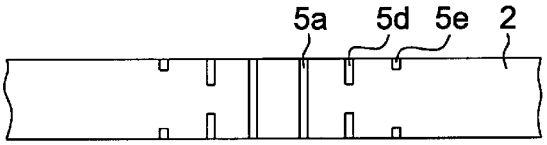
FIG 17
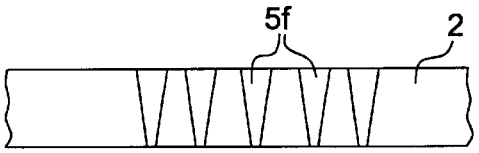

SKI STRUCTURE

This is a Continuation of application Ser. No. 08/154,521 filed Nov. 19, 1993, now abandoned.

FIELD OF THE INVENTION

The invention relates to a ski structure including a core possibly provided with reinforcing elements and associated with upper and lower covering elements.

BACKGROUND

The core of a ski can be made in different ways, for example, by superimposing or juxtaposing a number of wooden elements in the form of layers assembled with one another, by assembling parts made of different materials, such as parts made of synthetic material, wooden parts, and resin-impregnated fabric, by machining an alveolar structure, such as an aluminum or paper honeycomb, or by injecting a foam made of a synthetic material.

All skis known heretofore can be equated with beams having relatively good elastic characteristics, or in other words capable of resuming their initial shapes after being deformed. However, depending on the materials used in the ski structure, the time required for the ski to return to the original shape can vary considerably. This type of feature defines the liveliness of a ski. The behavior of the ski is intimately linked to its ability to react to passing over bumps and hollows and in making turns.

Certain skis, especially skis whose core is made of injected synthetic material with a covering part simultaneously forming the upper and side surfaces of the ski, frequently exhibit a lack of liveliness which is disadvantageous for the behavior of the ski. In addition, the use of certain materials or the choice of certain shapes can also result in excess damping of the ski, conferring nondynamic behavior on the ski.

It is known from AT 388,875 to make a ski whose structure is composed of a plurality of layers between which elastic films are interposed. These films work in shear, permitting relative displacement of the various layers of the structure, thereby improving flexibility and especially the solidity of the ski.

Another significant characteristic of a ski is the ability to absorb vibrations generated by an impact of a sole of the ski with snow. These vibrations are microdeformations generated at high frequencies. A ski can be damped or resonant and its behavior, its ability to ski, and its comfort are linked to this.

Attempts have been made to trap the propagation of vibrations between the tip and the area of the ski on which a skier's foot is mounted by a barrier constituted by an damping element. Document FR 2,599,636 describes a ski of this type, in which the core is made of a hard material and therefore resonant. This arrangement is designed to limit the propagation of the vibrations described, by providing cells in the faces of the core and placement in these cells of a material that absorbs the vibrations.

Document FR 2,618,344 describes a device that is designed to prevent propagation of vibrational waves not only at the surface but also inside the core structure. This damping is obtained by providing plugs of an absorbent material in the median plane of the core.

SUMMARY OF THE INVENTION

The invention includes a structure which, possibly possessing specific damping means, is also provided with elements that allow the ski, when deformed following a stress, to resume the ski's initial shape within a predetermined time, defined as a function of various parameters, for example, the specificity of the ski (short turns, long turns), its structure, its speed during use (competition or not), the desired comfort, etc.

The ski structure in accordance with the invention includes a core possibly provided with reinforcing elements, associated with upper and lower covering elements, and provided with at least one block of elastic, hyperelastic, or viscoelastic material located in a cavity of the core and terminating in the upper surface and/or in the lower surface of the core. The cavity is blocked by the upper and/or lower covering element, and/or the sides of the ski. The height of each block is preferably greater than 5 mm, while the ratio between the block height and the block length, in other words the block's dimension viewed along the length of the ski, is between 0.3 and 7.

The blocks in accordance with the invention do not work in shear, as is the case for vibration-damping elements, but in compression-traction. Accordingly, when a ski is deformed, the shape of the cavity in which each block is housed is changed, thus changing the shape of each block of elastic, hyperelastic, or viscoelastic material. As soon as the block is no longer under constraint, for example, from the deformation of the ski, it tends to resume its original shape, promoting the return of the ski to its original shape.

BRIEF DESCRIPTION OF THE DRAWINGS

The following description with reference to the attached drawings show several nonlimiting embodiments in accordance with the invention:

FIG. 1 is a view of a ski in cross section through the lengthwise median plane;

FIG. 2 is a top view of the ski in FIG. 1 after removal of the covering element;

FIG. 3 is a cross section through a lengthwise median plane of the central zone of the ski in FIG. 1;

FIG. 4 is a cross section similar to FIG. 3 in which the blocks are of different heights;

FIGS. 5 to 8 are four perspective views of four blocks;

FIG. 9 is a perspective view of four blocks connected together;

FIGS. 10 to 12 are three perspective views corresponding to three blocks made of an incompressible material;

FIGS. 13 and 14 are two top views of two series of blocks in which the blocks are connected together;

FIGS. 15 to 20 are six top views of a part of a ski in which the upper covering element has been removed, corresponding to six possible arrangements of the blocks;

DETAILED DESCRIPTION OF EMBODIMENTS

Figure 18:
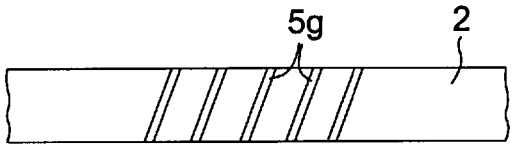

In an embodiment, each block can be made of a compressible material and have a homogeneous structure throughout its volume. In another embodiment, each block can be made of an incompressible material and can contain a cavity allowing for deformation of the block.

Deformation of the ski results in a change in the volume of the cavity in the core. If the block located in this cavity is made of compressible material, the progressive restriction of a length of the cavity and hence of its volume compresses the block more and more, exerting an increasing force against front and rear walls of the cavity, which tends to cause the ski to resume its original position.

If the block is made of incompressible material, the progressive restriction of the length of the cavity and hence of its volume deforms it until it occupies the volume of the cavity that permits its deformation. The resistance of the material of the block is relatively constant until the deformation space is occupied. Then, because the material is incompressible, the resistive effort increases very rapidly. As a result of using such a material, a dual resilience effect is obtained, gentle elastic reaction, then blockage of this effect, with the elasticity of the ski becoming that of the rest of the structure.

Each block can be in the form of a shaped element with a general orientation in the direction of the width of the ski. Each block can extend over the entire width of the ski or over only a portion of the width. Each block can have a constant cross section over its entire length or it can have a variable section. Each block can be oriented perpendicular to a lengthwise axis of the ski, or it can form an angle relative to a perpendicular to the lengthwise axis. A core of the ski structure can have several identical blocks, or a plurality of different blocks differing from one another both in shape, section, and positioning in the ski. In another embodiment, each block can be made in the form of an element with a symmetry of revolution around an axis perpendicular to the plane of the ski. It should be noted, however, that in order for each block to perform its function by acting in compression-traction, its dimensions should distinguish it from those of a film.

In accordance with an embodiment, a plurality of blocks is associated with a given support, the support is made by bars produced by, for example, being molding with the blocks. In another embodiment, a plurality of blocks are made independently and can be mounted on a common part, for example by gluing. The common part can include the upper or lower covering element of the core, or a part which, associated with the core, is designed to promote the mounting of bindings on the ski.

According to another embodiment, several blocks are mounted on one elongate reinforcing element, such as a piano wire. This embodiment enables the block to perform a double function: an absorbent function by a shearing motion at the level of the reinforcing element with which it is associated; and a function involving "dynamization" of the ski due to the function of compression-traction in the cavities in which they are located.

The blocks can be located in the central zone and/or in end zones of the ski and can be arranged in symmetrical or asymmetrical fashion relative to a lengthwise median plane of the ski.

According to another embodiment in accordance with the invention, the ski structure includes two blocks, one of which is located in front of and one behind a central zone of the ski, and extend over the entire cross section of the core. This embodiment makes it possible to isolate the runner area from the ends of the ski.

FIG. 1 shows an embodiment of a part of a ski including a core 2 covered on an upper surface by a covering element 3. Core 2 has cavities 4, seven in number, terminating in the upper surface of the core, oriented in a direction of a width of the ski, and arranged in a central zone. Cavities 4 have a triangular cross section and an apex that is located in a middle of the ski and a base that terminates in the upper surface of core 2. In the embodiment shown in FIGS. 1 to 3, all of the cavities are of the same height. Each cavity accommodates one block 5 made of an elastic, hyperelastic, or viscoelastic material having properties of compressibility.

FIG. 4 shows a variation of the structure shown in FIGS. 1 to 3 in which the height of the cavities varies depending on their location. Thus, central cavity 4*a* has the greatest height (H2) while the respective heights of the adjacent cavities decrease until cavity 4*b*, furthest from cavity 4*a*, has a height (H1).

FIGS. 5 to 8 show four embodiments of blocks made of a compressible or incompressible material, each including a shape with a constant cross section. In the embodiment shown in FIG. 5, block 15 has a cylindrical shape. In the embodiment shown in FIG. 6, block 25 has a triangular section. In the embodiment shown in FIG. 7 block 35 has a semicylindrical shape. In the embodiment shown in FIG. 8, block 45 has a parallelipipedic shape.

FIG. 9 shows four blocks 55, with a symmetry of revolution around an axis perpendicular to the plane of the ski. Each block 55 comprising a cone that is joined to the adjacent block by a bar 6, where the set of blocks 55 and bars 6 are molded in one piece.

FIGS. 10 to 12 show three blocks corresponding respectively to the blocks in FIGS. 5, 6, and 8, but made of an incompressible material. Block 15*a* shown in FIG. 10 has a central cavity 7*a*. Block 25*a* has a central cavity 7*b*. Block 45*a* shown in FIG. 12 has a central cavity 7*c*.

FIG. 13 shows a set of blocks 55 with a conical or spherical shape joined together by bars 6 to form a network.

FIG. 14 shows a top view of a plurality of blocks 5 identical in shape to those in FIGS. 5 to 8 and connected by bars 8 to form a comb.

FIG. 15 shows an embodiment in which all of the blocks are arranged in symmetrical fashion relative to the median lengthwise plane of the ski and extending along the median lengthwise plane. The two central blocks 5*a* occupy the entire width of the ski while blocks 5*b* occupy only a part of the width of the ski, at a center of the ski, and blocks 5*c* have a very limited width at the center of the ski.

In the embodiment shown in FIG. 16 two central blocks 5*a* perpendicular to the lengthwise axis of the ski occupy the entire width thereof. Provision is then made on both sides of the central blocks for two series of blocks 5*d*, each block 5*d* extending from a side face of the ski toward the center thereof without reaching the center. This structure likewise comprises two series of two blocks 5*e* each extending from one side face of the ski and with a width that is shorter than the width of blocks 5*d*.

FIG. 17 shows a structure comprising blocks 5*f* of trapezoidal shape, all extending in a direction perpendicular to the length of the ski and having large bases that are all located on a same side of the ski.

FIG. 18 shows a structure wherein blocks 5*g*, each with a length that is constant over its entire length, are oriented parallel to one another, with their respective axes forming an angle with the perpendicular to the lengthwise axis of the ski.

Figure 19:
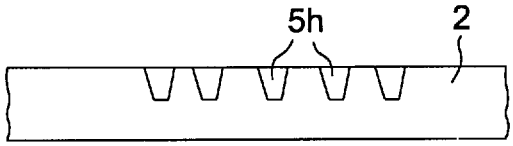

FIG. 19 shows a structure wherein blocks 5*h*, each with a trapezoidal shape, extend over half the width of the ski, starting at one of the side faces thereof.

Figure 20:
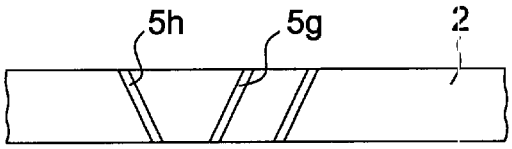

FIG. 20 shows a structure comprising two blocks 5*g* oriented in one direction and a block 5*i* oriented in the opposite direction, symmetrically relative to the perpendicular to the lengthwise axis of the ski.

Figure 21:
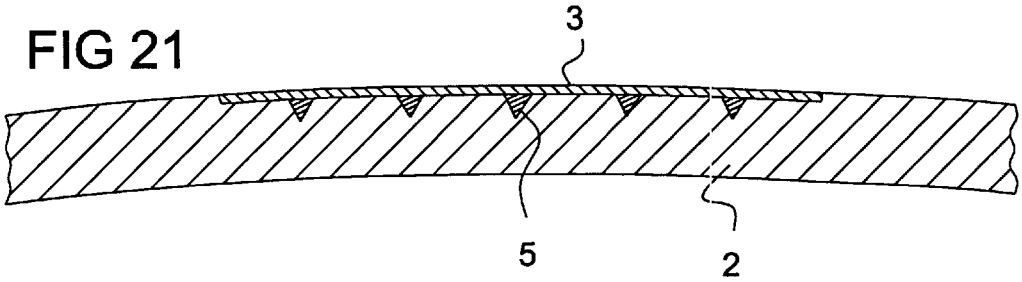
FIG. 21 is a section along the lengthwise median plane of a part of a ski provided with blocks attached to an element that is part of the framework of the ski.

In the embodiment shown in FIG. 21, a plurality of blocks 5 is mounted on a plate 9 which is for example a plate designed to improve the mounting of ski bindings.

Figure 22:
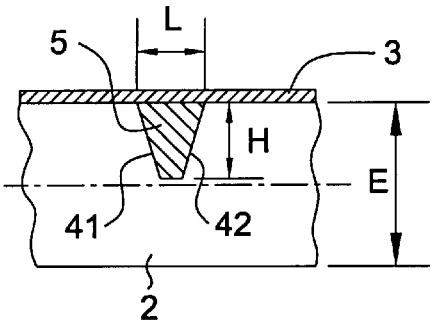
FIG. 22 is a view of a detail showing the relative proportions of a block made of a compressible material, with the ski being flat.
Figure 23:
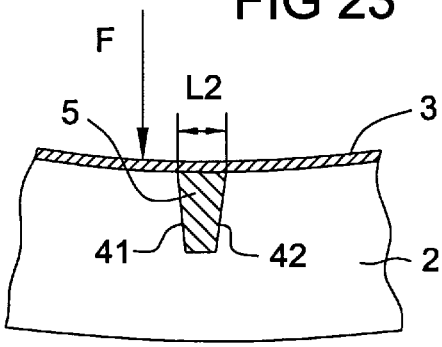
FIG. 23 is a view similar to FIG. 22, with the ski being arched.

In FIG. 22 the letters E, H, and L correspond respectively to the thickness of the core, the height of block 5, and the length of the block 5, and also to the block dimension considered in the lengthwise direction of the ski. In a preferred embodiment, H is greater than 5 mm and the ratio H/L is between 0.3 and 7.

For purposes of illustration, when the ski is flat, it does not undergo any flexural stresses and the block has a volume V1. When the ski is arched under force F block 5 assumes a volume V2 smaller than V1 because L2 is less than the initial length L. The block exerts an increasing force against front and rear walls 41 and 42, respectively, urging the ski to resume its original shape.

Figure 24:
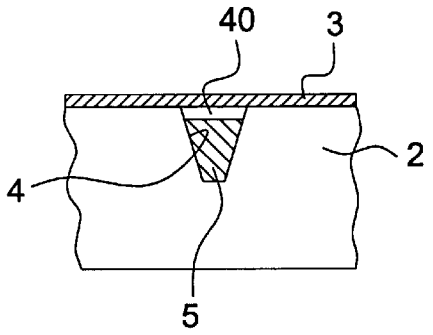
FIGS. 24 and 25 are two views corresponding to FIGS. 22 and 23 respectively, and with an incompressible block.
Figure 25:
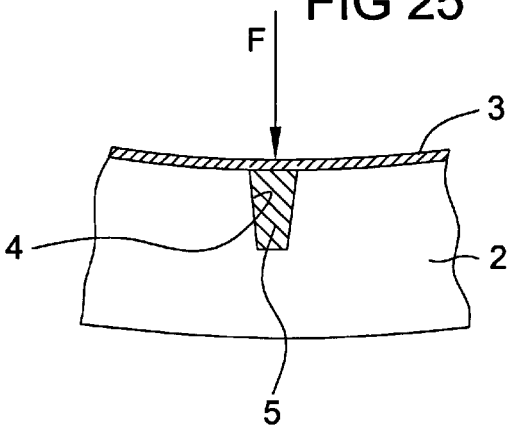

In the embodiment shown in FIGS. 24 and 25, cavity 4 contains a block 5 made of an incompressible material, with a space 40 between the block and the upper covering element 3 when the ski is at rest, as shown in FIG. 24. If the ski is arched under a force F, the length of the cavity decreases, compressing the block which is deformed until it totally fills cavity 4 and eliminates space 40, offering slight resistance. This resistance is approximately constant until deformation space 40 is occupied. Then, since the material of the block is incompressible, the resistive effort increases rapidly, with blockage of the elastic effect.

Depending on whether the core is made of wood, polyurethane, or with a more complicated structure, it is possible after manufacturing the core to make cavities 4 designed to receive the blocks and then inject the blocks into the cavities or, if the blocks were obtained previously, to glue them into the cavities.

In the case of skis with an injected core, the blocks can be attached to upper covering element 3 and/or on the lower covering element, or on an insert such as that 9 shown in FIG. 21. If this is the case, it is useful to have the blocks joined together like a comb, a chain, or a network like that shown in FIGS. 9, 13, and 14.

Figure 26:
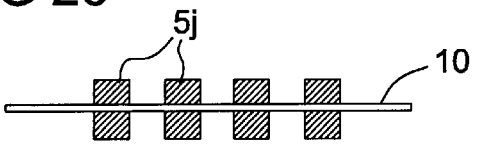
FIG. 26 is a lengthwise section through a series of blocks mounted on a given support, which includes a piano wire.

FIG. 26 shows an embodiment in which blocks 5*j*, mounted on a covering element of the ski, are likewise fitted on a reinforcing element of structure 10, for example, a piano wire. In such a case, the blocks function as a "dynamizing" element of the ski but at the same time provide damping of shear at the level of piano wire 10.

Figure 27:
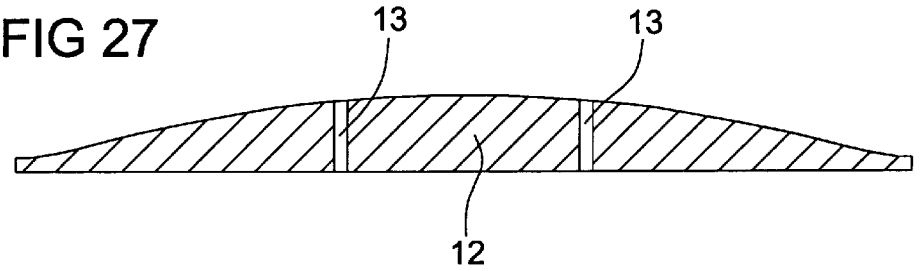
FIG. 27 is a side view of the core of a ski including two blocks in front of and behind the central zone.

In the embodiment shown in FIG. 27 the core comprises, in front of and behind the central zone 12, two blocks 13 which extend over the entire cross section of the core. It is thus possible to isolate the area of the runner from the ends of the ski, which improves user comfort while making it possible to produce a high-performance ski, taking into account the compression-traction function of blocks 13.

It should be noted that the blocks can each be made of a single material or by combining several materials.

Of course, the various embodiments of the blocks described above could be implemented either independently or in combination without thereby departing from the scope of the invention.

What is claimed is:

1. A ski comprising:

a core having an upper surface and a lower surface, the upper surface being covered by an upper covering element and the lower surface being covered by a lower covering element;

at least one cavity having multiple faces including front and rear walls being longitudinally separated, the cavity being formed in the core and terminating in at least one of the upper surface and the lower surface of the core and being blocked by at least one of the upper covering element, the lower covering element and sides of the ski, such that the at least one cavity is closed on all its faces to delimit a closed cavity having a specified volume; and at least one block, wherein at least one said block is provided in each of the at least one cavity, the at least one block having a surface adapted to contact at least the front and rear walls of the cavity upon flexion movement of the ski, the at least one block having a height and a length, wherein the height of the at least one block is greater than 5 mm and a ratio between the height and the length along a length of the ski of each block is between 0.3 and 7;

such that during flexion movement of the ski, each of the at least one cavity deforms by changing the longitudinal separation between the front and rear walls, thereby changing the volume of the cavity and compressing the at least one block, which exerts a resistive force that increases with the amplitude of the deformation, since the at least one block is blocked inside the closed cavity.

2. A ski according to claim 1, wherein said at least one block is arranged in a runner area of the ski.

3. A ski according to claim 1, wherein the at least one block is arranged at at least one end of the ski.

4. A ski according to claim 1, wherein the at least one block is made of a compressible material.

5. A ski according to claim 4, wherein the at least one block has a structure that is homogeneous throughout a volume of the at least one block.

6. A ski according to claim 4, wherein the at least one block contacts at least one of the upper and lower covering elements.

7. A ski according to claim 1, wherein the at least one block is made of an incompressible material.

8. A ski according to claim 7, wherein the at least one block has an interior cavity.

9. A ski according to claim 7, further comprising a space provided between the at least one block and at least one of the upper and lower covering element.

10. A ski according to claim 1, wherein the at least one block has a profiled shape and has a general orientation in a direction of a width of the ski.

11. A ski according to claim 10, wherein the at least one block extends over substantially the entire width of the ski.

12. A ski according to claim 10, wherein the at least one block extends over only a part of the width of the ski.

13. A ski according to claim 10, wherein the at least one block has a cross section that is constant over the width of the ski.

14. A ski according to claim 10, wherein the at least one block has a cross section that varies over the width of the ski.

15. A ski according to claim 10, wherein the at least one block is oriented perpendicular to a lengthwise axis of the ski.

16. A ski according to claim 10, wherein the at least one block is oriented at an angle relative to a perpendicular to a lengthwise axis of the ski.

17. A ski according to claim 10, wherein the core of the ski comprises a plurality of identical blocks.

18. A ski according to claim 10, wherein the core of the ski comprises a plurality of different blocks.

19. A ski according to claim 1, wherein the at least one block has a shape that has a symmetry of revolution around an axis perpendicular to a plane of the ski.

20. A ski according to claim 1, wherein there is a plurality of blocks being connected together by at least one bar, wherein the bar is molded integrally with the plurality of blocks.

21. A ski according to claim 1, wherein there is a plurality of blocks disposed symmetrically relative to a lengthwise median plane of the ski.

22. A ski according to claim 1, wherein there is a plurality of blocks arranged asymmetrically relative to a lengthwise median plane of the ski.

23. A ski according to claim 1, wherein the core comprises a first block and a second block, the first block being located in an area in front of a central zone of the ski and the second block being located in another area behind the central zone, the first and second blocks each extending over an entire cross section of the core of the ski.

24. A ski according to claim 1, wherein the at least one block is made of at least one of an elastic material, a hyperelastic material and a viscoelastic material.

25. A ski according to claim 1, wherein the upper covering element covers the at least one cavity.

26. A ski according to claim 1, wherein there is a plurality of blocks associated with a support.

27. A ski according to claim 26, wherein there is a plurality of blocks mounted on an elongate reinforcing element.

28. A ski according to claim 27, wherein said elongate reinforcing element comprises piano wire.

* * * * *